United States Patent [19]

Elter

[11] 4,021,641

[45] May 3, 1977

[54] RADIANT FUSER FOR FIXING TONER IMAGES

[75] Inventor: John F. Elter, Webster, N.Y.

[73] Assignee: Xerox Corporation, Stamford, Conn.

[22] Filed: Feb. 2, 1976

[21] Appl. No.: 654,494

[52] U.S. Cl. ..... 219/216; 219/388; 250/317

[51] Int. Cl.[2] ..... H05B 1/00; G03G 15/20

[58] Field of Search ..... 219/216, 388; 432/59, 432/60, 227, 228; 250/317–319; 355/3 FU

[56] References Cited

UNITED STATES PATENTS 3,811,828 5/1974 Ohta ..... 219/216

OTHER PUBLICATIONS

G. T. Williams, Image Fuser, "IBM Technical Disclosure Bulletin," vol. 13, No. 10, Mar. 1971, p. 3072.

*Primary Examiner*—C. L. Albritton

[57] ABSTRACT

Apparatus for heat fixing toner images electrostatically adhered to copy paper. The apparatus is characterized by the provision of a radiant energy source together with a parabolic reflector and lens structure for focusing the energy onto the toner images. The lens structure in the preferred embodiment comprises a Fresnel lens which is fabricated in the form of a belt entrained about the reflector and energy source which belt is adapted to be moved relative to the reflector and the heat source.

6 Claims, 2 Drawing Figures

RADIANT FUSER FOR FIXING TONER IMAGES

BACKGROUND OF THE INVENTION

This invention relates generally to electrostatographic apparatus and, more particularly, to radiant energy apparatus for fixing toner images to substrate material.

In the process of electrostatography, latent electrostatic images are formed on a support member, for example, plain paper with the subsequent rendering of the latent images visible by the application of electroscopic marking particles, commonly referred to as toner.

The toner images can be fixed directly on the support member on which they are formed or they may be transferred to another support member with subsequent fixing of the images thereto.

Fixing of toner images can be accomplished by various methods one of which is by the employment of thermal energy. In order to permanently fix a fused toner image onto a support member by means of thermal energy, it is necessary to elevate the temperature of the toner material to a point at which the constituents of the toner coalesce and become tacky or melt.

This action causes the toner to be absorbed to some extent into the fibers of the paper. Thereafter as the toner cools, solidification of the toner material occurs causing it to be firmly bonded to the support member. In the process of electrostatography, the use of thermal energy for fixing toner images is old and well known.

One approach to thermal fusing of toner images onto a support member is to pass the support with the toner images thereon past a source of radiant energy such that the image bearing side of the support is opposite the source of radiation while the reverse side thereof is moved in contact with a support platen.

Reflectors are normally employed in conjunction with the source of radiant energy to focus the energy on the toner images carried on the support material.

More recently the utilization of a lens in the radiant fuser for improving thermal efficiency has been recognized (i. e. U.S. Pat. No. 3,811,828. The lens is utilized in conjunction with what appears to be a parabolic reflector and is interposed between the source of radiant energy and the toner images to be fused.

Furthermore, the aforementioned patent recognizes that a stationary guide interposed between the source of radiant energy and the images has certain shortcomings, therefore, adverse effects of continued exposure to elevated temperatures and where the stationary guide contacts the toner images the accumulation of excess toner on its surface.

Notwithstanding the fact that the structure disclosed in the aforementioned patent represents an improved radiant fuser system it falls short of being a totally acceptable device for its intended purposes.

Accordingly, the primary object of this invention is to provide an improved radiant fuser device for fixing toner images to substrate material.

A more particular object of this invention is to provide, in a radiant fuser device for fixing toner images to substrate material, a moving lens and guide structure interposed between the energy source and the toner images.

Another object of this invention is to provide a guide structure for a radiant fuser wherein the guide structure is so designed as to minimize the adverse effects of the radiant energy source.

A further object of this invention is to provide a guide structure for a radiant fuser wherein the structure is designed to minimize toner offsetting thereto.

Yet another object of this invention is to provide a radiant fuser device comprising less elements thereby facilitating manufacture and minimizing costs thereof.

Still another object of this invention is to provide a radiant fuser for fixing toner images to substrate material which lends itself to greater design latitude through the employment of a lens and parabolic reflector for focusing energy onto the toner images.

BRIEF SUMMARY OF THE INVENTION

Briefly, the above-cited objects are accomplished by the provision of a radiant fuser device comprising a source of radiant energy which may be conventional and a parabolic reflector which cooperates with a Fresnel lens for focusing the energy from the source onto toner images.

By the provision of the Fresnel lens and the parabolic reflector the number of design parameters for the fabrication of the reflector is substantially increased. Thus, for a fixed focused image width and lamp to paper distance, there exist a variety of different reflector sizes depending upon the focusing characteristics of the Fresnel lens.

In the preferred embodiment of the invention, the Fresnel lens is constructed in the form of a belt which is supported by a plurality of thermally conductive rolls such that the belt is entrained about the energy source and the parabolic reflector. The belt thereby forms a conduit through which air can be moved in order to cool the lens and also cool the reflector.

A drive means is provided for moving the belt about the support rolls whereby different portions of the lens are brought into registration with the energy emanating from the radiant energy source. The result of such movement is to effect further cooling of the lens by virtue of its contact with the support rolls which act as heat sinks. Additionally, movement of the lens, in cases where the lens is in contact with the toner images, tends to minimize the relative velocity therebetween and thereby minimize toner offsetting to the lens.

While the preferred embodiment is considered to be a Fresnel lens structure in the form of a belt, it would also be within the scope of the invention to employ a belt comprising a lens strip arrangement wherein the lens strip elements would be brought into registration with the energy emanating from the radiant source on an intermittent basis. A further advantage of provision of the Fresnel lens is that it is possible with some configurations to move the belt on a continuous basis and further that because of its construction it presents less surface area to the toner images than does a conventional belt such as that shown in the patent discussed above. The foregoing is significant in the reduction of offset toner to the belt.

Further objects and advantages of the present invention will be become apparent in view of the detailed description to follow when read in conjunction with the accompanying drawings wherein:

FIG. 1 illustrates schematically a front plan view of a radiant fuser apparatus representing the invention; and FIG. 2 represents an enlarged elevational view of a combination lens and guide structure forming a part of the fuser device illustrated in FIG. 1.

DETAILED DESCRIPTION OF THE PREFERRED EMBODIMENT

Figure 1:
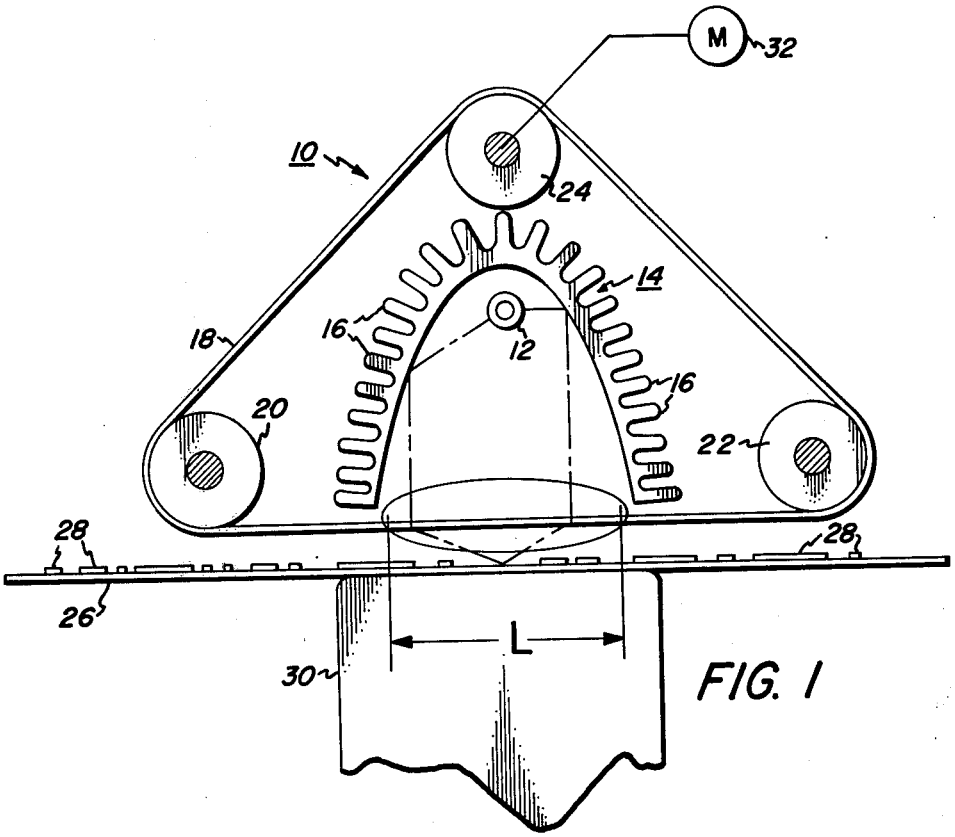

FIG. 1 of the drawings illustrates a radiant fuser apparatus suitable for fixing toner images to substrate material pursuant to a xerographic reproducing process. It is believed that the xerographic process is sufficiently well known and that for purposes of the present invention a description of such process need not be set forth. However, for those who would deem such a description necessary for a complete understanding of the present invention reference may be had to U.S. Pat. No. 3,849,907 which patent is incorporated herein by reference.

As shown in FIG. 1, a fuser apparatus 10 comprising a source of radiant energy 12 is provided which preferably comprises a quartz lamp designed to operate at a temperature of 2400° K at a power level of approximately 1100 watts. Quartz lamps for the purpose intended are well known, consequently, no further discussion thereon will be presented.

In order to focus the energy emanating from the radiant source 12 there is provided a parabolic reflector 14 having a plurality of fins 16 serving to conduct thermal energy from the backside of the reflector. The reflector 14 cooperates with a lens structure 18 which is fabricated in the form of a belt entrained about a plurality of rolls 20, 22 and 24. The rolls are preferably fabricated from a thermally conductive material such as copper in order to conduct heat from the belt as the belt is moved in contact therewith in a manner to be described more fully hereinafter. It will be appreciated that the belt encompasses the reflector and thereby forms a conduit containing the reflector 14. The conduit is adapted to have air move therethrough for the purpose of removing heat from the belt 18 and from the fins 16 of the reflector 14.

As support material 26 having toner images electrostatically adhered thereto moves through the fuser 10 it is supported on its underside (i. e. the side opposite the one containing toner images) by a support platen 30 which may be heated in order to prevent its acting as a heat sink which would remove thermal energy from the copy paper.

A motor 32 shown schematically in FIG. 1 is operatively coupled to one or more of the support rollers 20 through 24 in such a manner that, in the preferred embodiment of the invention, the belt or lens 18 can be moved intermittently such that different portions thereof are moved into registration with the energy from the source 12. Suitable controls, not shown, can be provided for controlling the motor in an intermittent operation to effect intermittent movement of the belt 18 or the motor 32 could be employed in combination with a conventional clutch mechanism which would effect the desired results. As the belt moves in contact with the rolls supporting the belt for such movement they extract thermal energy therefrom, particularly the roll 22 which contacts the portion of the belt just after it moves out of thermal contact with the radiant energy.

Figure 2:
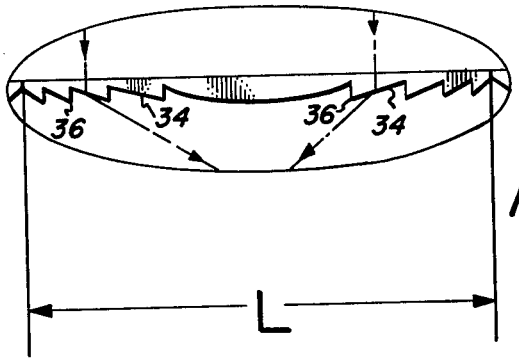

As shown in FIG. 2, the lens structure 18 comprises a Fresnel lens having surfaces 34 which transmits the energy from the source 12 and edges 36 which may be contacted by the paper 26 and toner images 28. It will be appreciated that the surface of the Fresnel lens facing the copy paper 26 has a reduced area for contacting the toner images. Consequently, offset of toner to the Fresnel lens by contact therewith is substantially minimized as compared to a conventional belt.

The Fresnel lens 18 is preferably fabricated from a high temperature material which is radiation transmissive and relatively abhesive (i. e. low affinity for toner). The belt or lens 18 not only serves to focus the energy from the source 12 but also acts as a guide for the paper 26 moving past the radiant energy source. Typical material for fabrication of the lens 18 comprises Mylar, Tefzel, Tedlar, Kapton.*

*Trademark of E. I. Dupont DeNemours & Co.

While the invention has been described in conjunction with the preferred embodiment thereof, it will be appreciated that modifications thereto will be readily apparent from the disclosure, for example, the lens 18 could be continuously moved and the lens could be made up of a plurality of lens strip elements in lieu of the Fresnel lens construction, and the foregoing modifications and other modifications within the scope of the invention are considered to be covered within the claims appended hereto.

What is claimed is:

1. Radiant fuser apparatus for fixing toner images to substrate material, said apparatus comprising:

a source of radiant energy; and means including a reflector and lens structure for focusing said radiant energy on said toner images, said lens structure being in the form of a belt which forms a conduit through which air can be moved for cooling of said lens structure said reflector and said source of radiant energy being disposed with said conduit with said source of radiant energy being disposed intermediate a portion of said lens and said reflector.

2. Apparatus according to claim 1 including means including a plurality of support rolls for effecting movement of said belt relative to said reflector.

3. Apparatus according to claim 2 wherein said support rolls are fabricated from thermally conductive material whereby they act as heat sinks for removing heat from said belt.

4. Apparatus according to claim 3 wherein said means for effecting movement does so intermittently.

5. Apparatus according to claim 4 wherein said lens structure comprises a Fresnel lens.

6. Apparatus according to claim 1 wherein said reflector comprises a parabolic configuration.

* * * * *